US006099450A

United States Patent [19]

Schenone et al.

[11] Patent Number: 6,099,450

[45] Date of Patent: Aug. 8, 2000

[54] SQUARING CARRIAGE WITH PNEUMATIC SQUARING FINGERS

[75] Inventors: Michael A. Schenone, Garfield, N.J.; Luc-Andre Neuenschwander, Ballaigues, Switzerland; Kevin Marston, Wanaque, N.J.; Daniel Cugnoni, Corseaux, Switzerland

[73] Assignee: Bobst Group, Inc., Roseland, N.J.

[21] Appl. No.: 09/351,061

[22] Filed: Jul. 9, 1999

Related U.S. Application Data

[60] Provisional application No. 60/092,144, Jul. 9, 1998.

[51] Int. Cl.[7] ..... B31B 1/06; B31B 1/60

[52] U.S. Cl. ..... 493/23; 493/110; 493/144; 493/141

[58] Field of Search ..... 493/23, 9, 110, 493/12, 29, 417, 423, 6, 8, 19, 34, 374, 379, 141, 144, 142; 198/531, 626.6, 626.5

[56] References Cited

U.S. PATENT DOCUMENTS

| | | | |
|---|---|---|---|
| 3,884,131 | 5/1975 | Palsson | 493/141 |
| 4,012,996 | 3/1977 | Stolkin et al. | 493/144 |
| 4,547,183 | 10/1985 | Mowry . | |
| 4,614,512 | 9/1986 | Capdeboscq . | |
| 4,976,672 | 12/1990 | Harrison . | |
| 5,217,425 | 6/1993 | Cantrell . | |
| 5,224,919 | 7/1993 | Walsh | 493/110 |

*Primary Examiner*—Peter Vo
*Assistant Examiner*—Hemant M. Desai
*Attorney, Agent, or Firm*—Allen N. Friedman; McCarter & English, LLP

[57] ABSTRACT

The disclosed squaring device utilizes an upper squaring carriage with compression belts and pneumatically actuated squaring fingers. In one embodiment, the upper squaring carriage includes at least three compression belts. At least one of the compression belts, central to the other belts, is positioned to apply direct pressure to the glued seam after the upper panels and lower panels are aligned. As a folded box reaches the end of the folding section and enters the squaring section, the moveable belt is raised so as not to apply pressure directly to the glued seam. The drive belts on either side of the seam maintain the box in compression. As the box approaches the squaring fingers, it passes a sensor that sends a signal to a programmable logic controller. At a selected time, depending on the conveyor belt speed, the controller actuates a pneumatic piston that drives a rack and pinion mechanism to rotate the squaring fingers into position to intercept the box travel. The bottom panel arrives at the fingers first, is stopped by the fingers, and slips on the lower conveyor belt. The upper compression belts continue to drive the upper panels forward until they arc also stopped by the squaring fingers, bringing the box precisely square. The squaring fingers are then retracted, permitting the squared box to continue through the machine. In a second embodiment of the inventive device the upper squaring carriage includes two compression belts, with squaring fingers positioned outward of the belts, with respect to the center line of the conveyor. The embodiments share the feature that the belts are controlled to exert a lower pressure on the boxes during the squaring operation and a higher pressure on the boxes after they are brought into square.

10 Claims, 7 Drawing Sheets

18
16
20
17
16
15
15
19
19
3
3
28
28

SQUARING CARRIAGE WITH PNEUMATIC SQUARING FINGERS

RELATED APPLICATIONS

This Application depends for priority on Provisional Application Ser. No. 60/092,144, filed Jul. 9, 1998.

GOVERNMENT FUNDED RESEARCH

Not Applicable

BACKGROUND OF THE INVENTION

1. Field of the Invention

The invention is in the field of box folding machinery.

2. Brief Description of the Background Art

In box folding machinery, particularly in the corrugated cardboard industry die cut box blanks arc fed into the folding section of a folder-gluer. The blanks are carried on a conveyor belt and the box sides are turned up by arms or belts for gluing to form the finished box. During the process glue is applied to an overlapping tab that is pressed onto the other box side as the folding is completed.

During this process, frictional forces produce a folding error known as "fish tailing" (See FIG. 1.) in which the upper panels at the glued seam, lag behind the lower panel that is being carried by the conveyor belt. Various methods have been devised to correct this folding error. For example, U.S. Pat. No. 4,547,183 discloses driving a set of upper belts, used to keep the folded box in compression while the glue sets, at a somewhat higher speed than the lower, conveyor belt in order to draw the upper panels forward. U.S. Pat. No. 5,217,425 makes similar use of upper drive wheels. However, adjustment of this system is critical and difficult to change from one box size to the next. With this method it is also difficult to stop driving the upper panels at the precise moment they are aligned with the lower panels.

In U.S. Pat. No. 4,976,672 gauge plates carried by an upper conveyor and moving in synchronism with the lower conveyor engage slots in both the leading and trailing edges of a folded box. This requires precise adjustment of the separation between the leading and trailing gauge plates for each box size.

In yet another prior art device, studs located below the lower conveyor are extended upward to intercept an approaching box being carried forward between the lower conveyor and an upper conveyor. The studs momentarily halt the forward progress of the box's lower panel, while the upper panel is urged forward by the upper belt, tending to square the box. While this approach has shown some promise, the prior art implementation has shown limited success. A reliable solution to the fish tailing problem is essential to the high-speed production of high quality boxes.

SUMMARY OF THE INVENTION

The squaring device disclosed here, positioned at the end of the machine's folding section, utilizes an upper squaring carriage with compression belts and pneumatically actuated squaring fingers. In one embodiment of the inventive device, the upper squaring carriage includes at least three compression belts. The squaring fingers, actuated by one or more pneumatic cylinders arc in line with the outer belts. All of the belts are driven at the same speed as the conveyor belt, preferably off a common machine drive shaft. At least one of the compression belts, central to the other belts, is positioned to apply direct pressure to the glued seam after the upper panels and lower panels are aligned. During the machine setup for a given run of boxes, the compression belts are height adjusted to accommodate any differences in the number of cardboard layers at the different positions across the folded box. The outer belts are then fixed in position. But the belt over the seam position is supported by a pneumatically actuated carriage that can be raised and lowered independently of the other belts.

As a folded box reaches the end of the folding section and enters the squaring section, the moveable belt is raised so as to apply little or no pressure directly to the glued seam. The drive belts on either side of the seam, made of a high friction belt material, maintain the box in compression. As the box approaches the squaring fingers, it passes a sensor that sends a signal to a programmable logic controller. At the appropriate time, depending on the conveyor belt speed, the controller actuates a pneumatic piston that, in this exemplary embodiment, drives a rack and pinion mechanism to rotate the squaring fingers into position to intercept the box travel. The bottom panel arrives at the fingers first, is stopped by the fingers, and slips on the lower conveyor belt. The upper compression belts continue to drive the upper panels forward until they are also stopped by the squaring fingers, bringing the box precisely square. The squaring fingers are then retracted and the central belt is lowered, permitting the squared box to continue through the machine with compression of the glued seam assuring maintenance of the squared condition.

The length of time the fingers are held in the down position is adjusted to accommodate the speed of the machine and the box size. For example, wider boxes tend to be more out of square and need a longer squaring drive time to bring the upper panels into line with the lower panel. Belt speeds can be up to approximately 800 feet per minute and squaring drive times of the order of 100 to 300 milliseconds are typical.

The readjustment of the glued seam is eased by the fact that, while the box is being squared, the central belt is raised and no direct pressure is being applied to the seam. After the box has been squared the squaring fingers are raised and the central belt lowered to press on the glued seam as the glue sets. All the belts arc running at the same speed as the lower conveyor belt so that there are no forces on the box tending to pull it out of square as it leaves the squaring device to enter the transfer section of the folder-gluer.

In a second embodiment of the inventive device the upper squaring carriage includes two compression belts, with squaring fingers positioned outward of the belts, with respect to the center line of the conveyor. The belts are positioned on either side of the box glue line and are independently mounted on pneumatically actuated carriages that can be raised and lowered independently. The pressure they exert on the folded boxes can be independently controlled by controlling the air pressure in a pneumatic piston pressing on a lever arm, to which the carriage is attached.

During machine setup for a particular box the pressures exerted by the upper compression belts are adjusted so as to maintain the box in the folded state, and to provide enough frictional force on the upper panels to drive the upper panels forward, but not so great as to lock the upper and lower panels together and prevent squaring.

As the box enters the squaring section, the pneumatic system is valved to exert the pressure described above. At the appropriate time the squaring fingers are driven downward to intercept the box travel, stopping the forward motion of the lower panel. The upper panel is driven forward until it reaches the squaring fingers at which time the fingers are retracted. Upon retraction of the squaring fingers, the pressure in the pneumatic cylinder controlling the upper belts is increased, increasing the pressure exerted by the upper belts on the squared box and clamping the upper and lower panels together, thus assuring the box is maintained in its squared state.

The embodiments share the advantage that the squaring fingers and the pneumatically controlled belts are all mounted on an easily controllable upper carriage and that the belts are controlled to exert a lower pressure on the boxes during the squaring operation and a higher pressure on the boxes after they are brought into square.

DETAILED DESCRIPTION OF THE INVENTION

Figure 1:
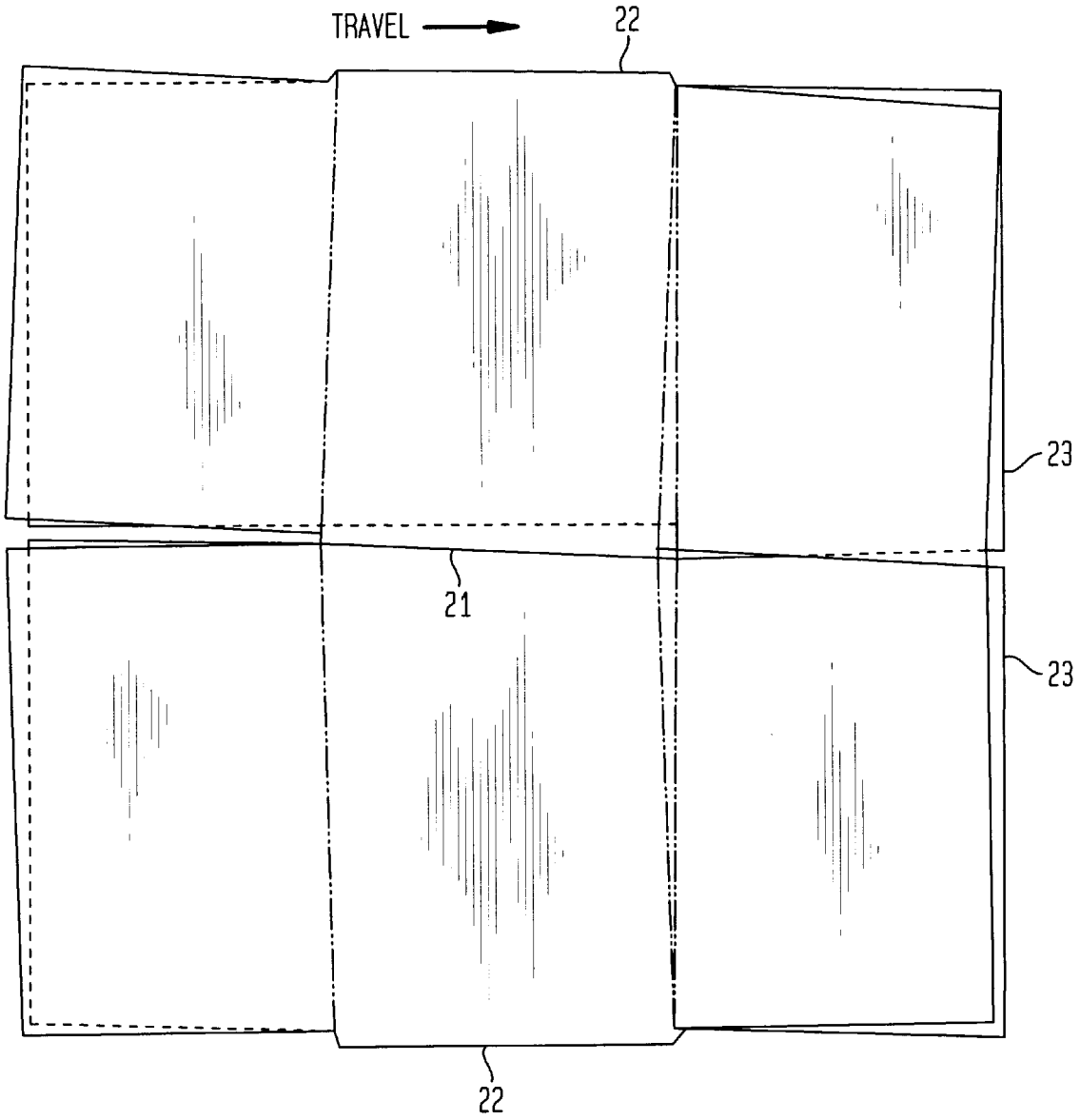
FIG. 1 is a plan view of a folded box, showing the fish and tail folding error.

The folding error, the cure of which is the principal objective of the invention, is illustrated in FIG. 1. Here, the glue seam 21 is at the joint between the box's upper panels 22. Because of friction in the folding operation, the upper panels lag behind the lower panels 23, producing the fish-tailing folding error that is corrected by the herein disclosed squaring device.

Figure 2:
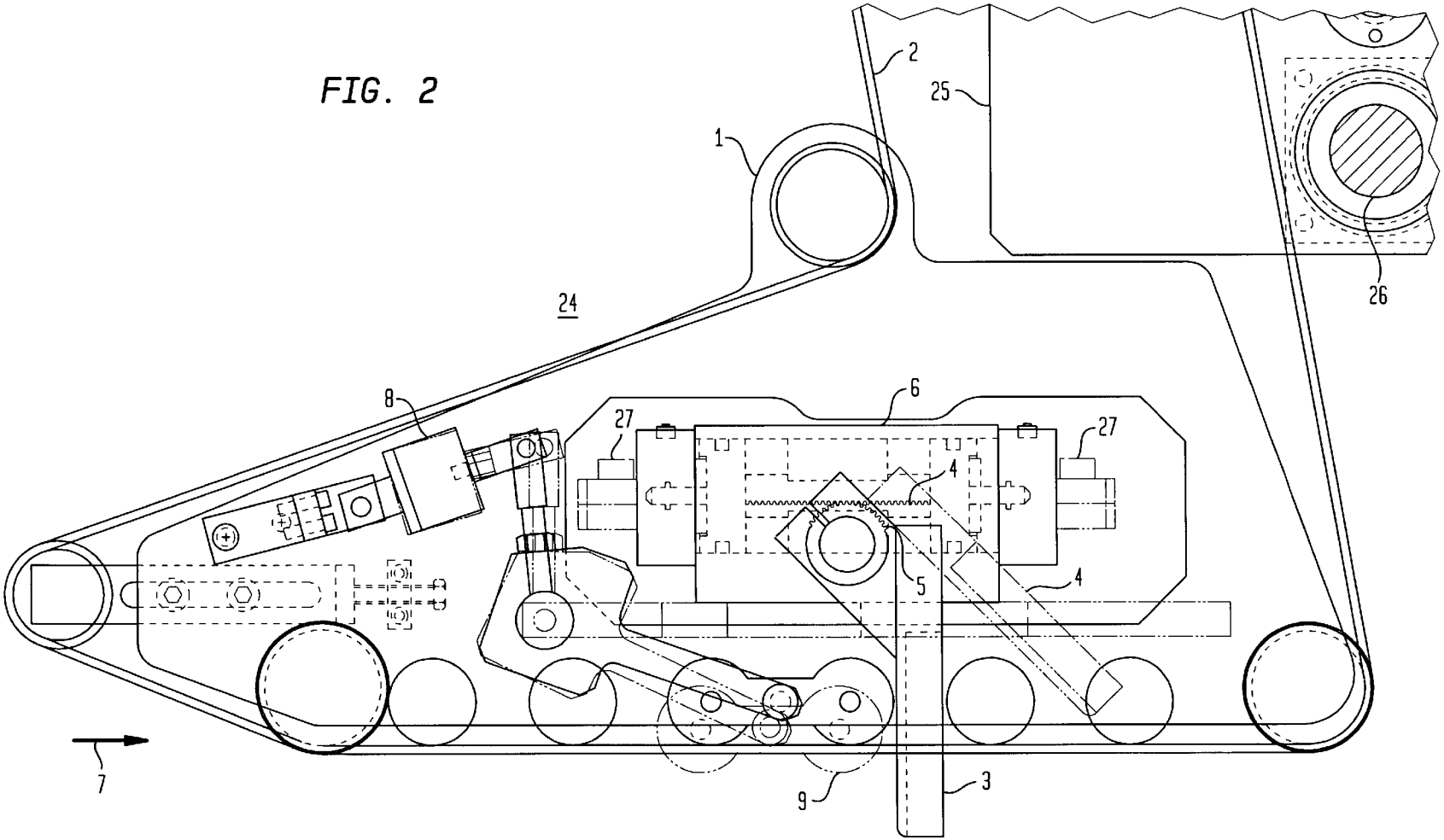
FIG. 2 is an elevational side view of an exemplary three belt upper squaring carriage showing the operation of a squaring finger and the center belt control.

The principle operative member is squaring carriage 24 shown in FIG. 2, supported above the main conveyor on a support plate 25. The support plate 25 can be laterally positioned by sliding it along a pair of support rods 26, one of which is shown in cross section. For the three belt squaring carriage illustrated in FIGS. 2–4, the squaring carriage 24 is laterally adjusted to position the central drive belt 2 above the box's glue seam 21.

The squaring fingers 3 are shown in the down (squaring) position. The fingers in the up position 4 are indicated in phantom. The fingers 3 are actuated, in this exemplary device, by a rack 4 and pinion 5 driven by a pneumatic cylinder 6. The arrow 7 indicates the direction of box travel. A second actuator 8 moves the belt central support rollers 9 up and down to reduce the pressure on the glued seam during the squaring operation and to apply pressure on the seam after the upper panels and lower panels are aligned. The rollers 9 in the down position are shown in phantom.

Figure 3:
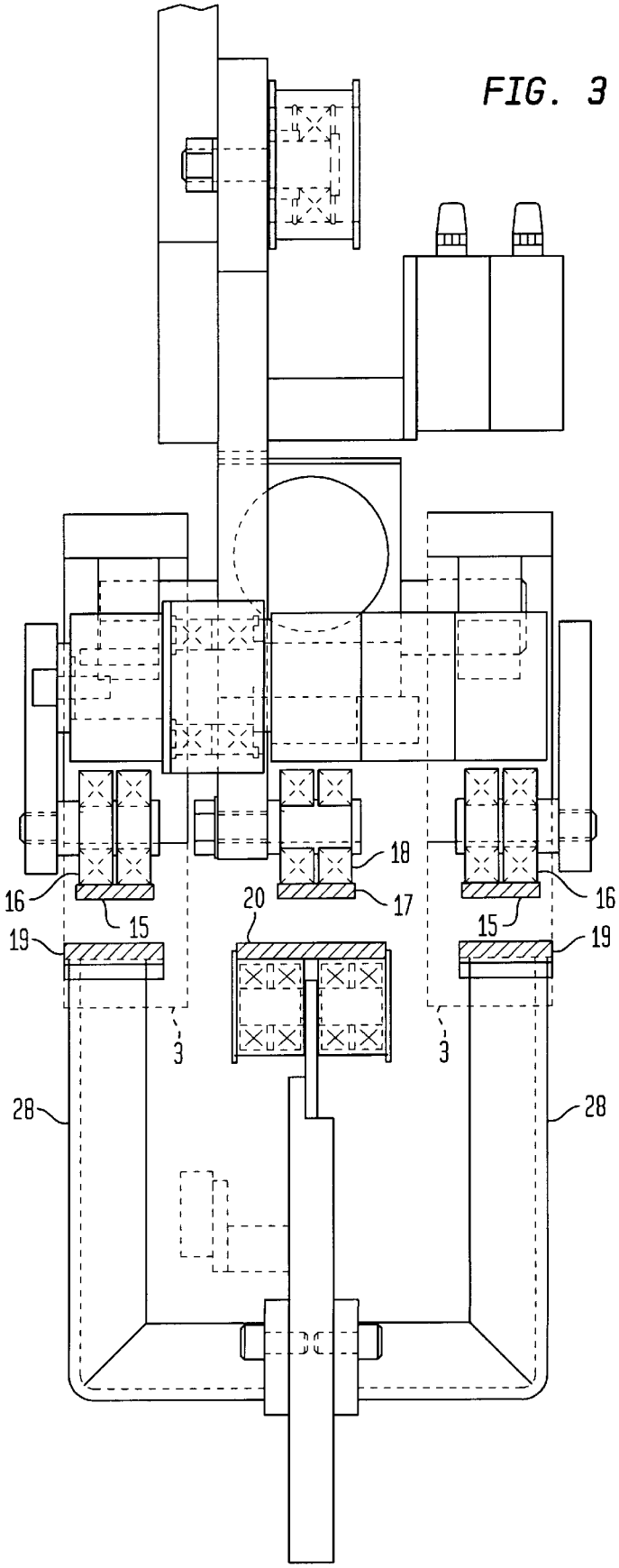
FIG. 3 is an elevational entry and view of a three belt squaring section.

FIG. 3 is a sectional view looking into the entry end of a squaring device with two squaring fingers 3. The two outer upper compression belts 15 are supported by the outer rollers 16 that remain fixed during machine operation. Central roller 18 that moves up and down during the squaring cycle supports the central belt 17. The two outer belts face skids 19, whereas the central belt 17 faces the main lower conveyor 20. The squaring fingers 3 arc shown in phantom in the down (squaring) position. The skids 19 can be replaced by drive belts run in synchronism with the lower conveyor 20.

Figure 4:
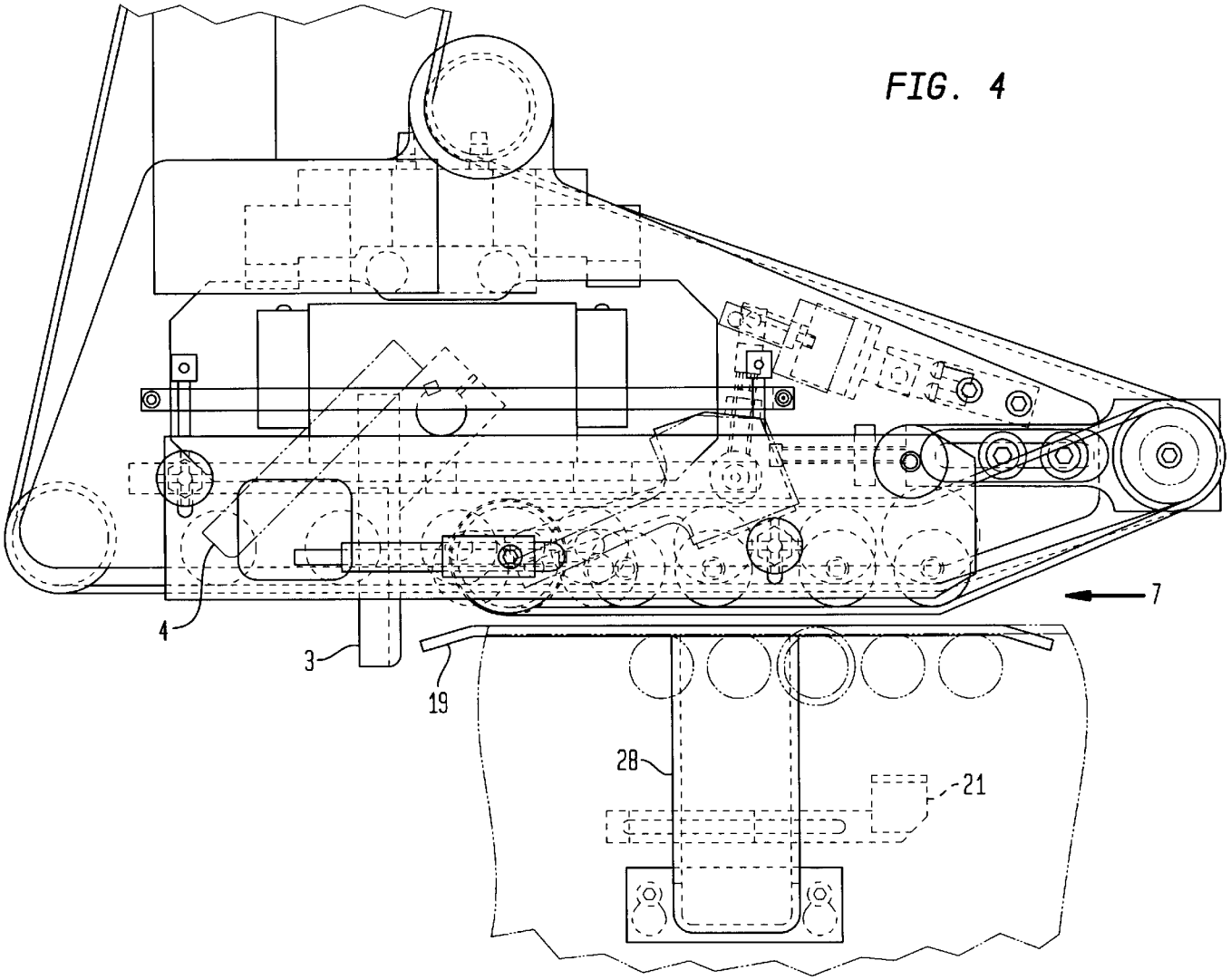
FIG. 4 is an elevational side view of a three belt squaring section.

FIG. 4 shows the elevation and lowering of the central belt in somewhat more detail and shows an adjustable support bracket 21 for a photocell positioned to detect the approach of the next box. The squaring fingers 3, 4 are shown a solid in the intercepting position 3 and in phantom 4 in the retracted position. The skids 19 are shown, carried by skid support arms 28. The arrow 7 indicates the direction of box travel.

Figure 5:
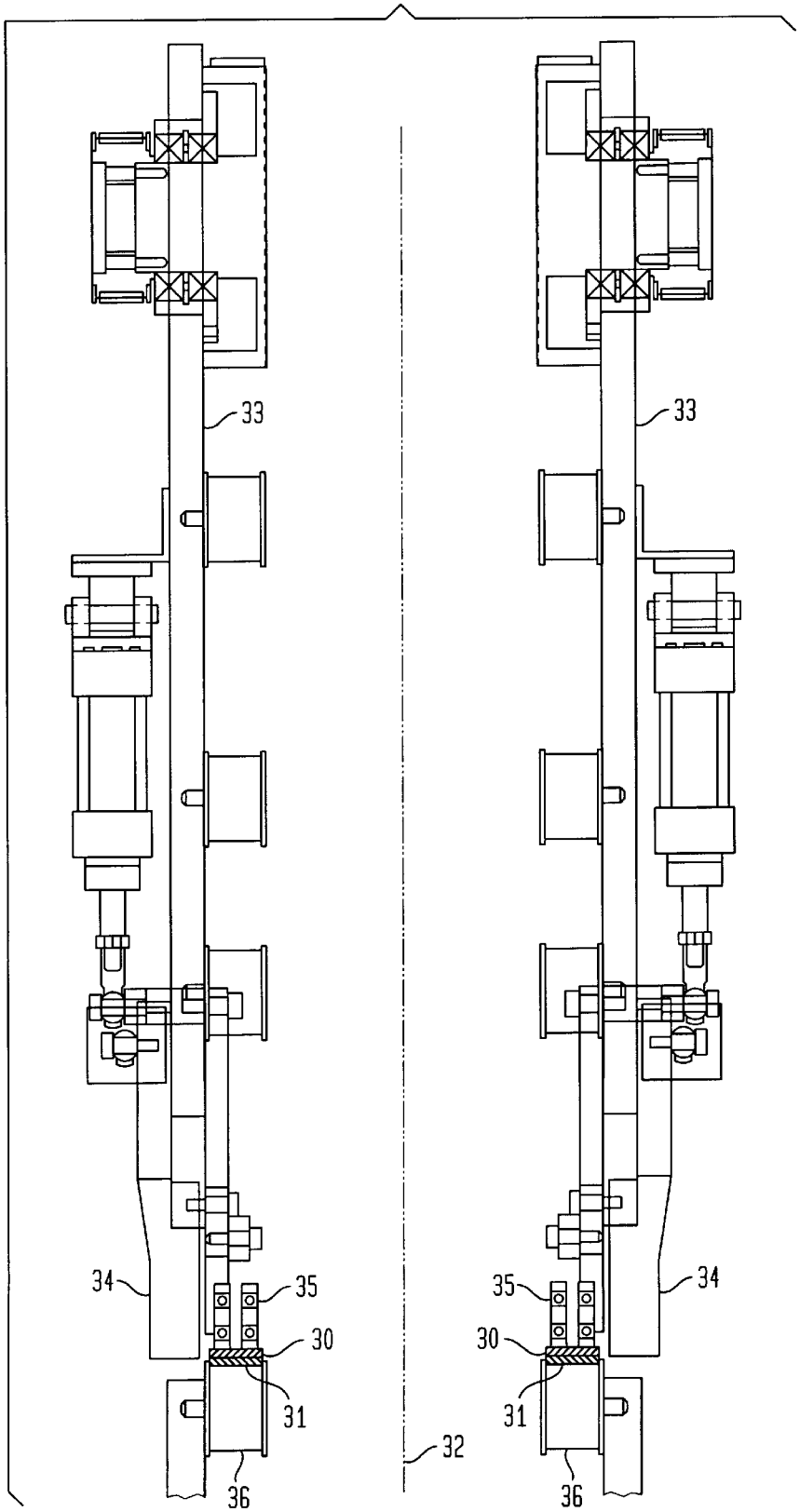
FIG. 5 is an elevational entry end view of a two belt squaring section.

FIG. 5 shows the entry end of elements of a two-belt squaring device. The upper compression belts 30 and lower conveyor belts 31 are laterally adjusted together, relative to the machine centerline 32, along which the glue line runs, to accommodate boxes of different size. The upper squaring carriage support plates 33 are slidably mounted on support rods 26, as shown in FIG. 2. The squaring fingers 34 are shown in the intercepting position. The upper compression belts 30 are supported by upper rollers 35 and the conveyor belts 31 are supported by lower rollers 36.

Figure 6:
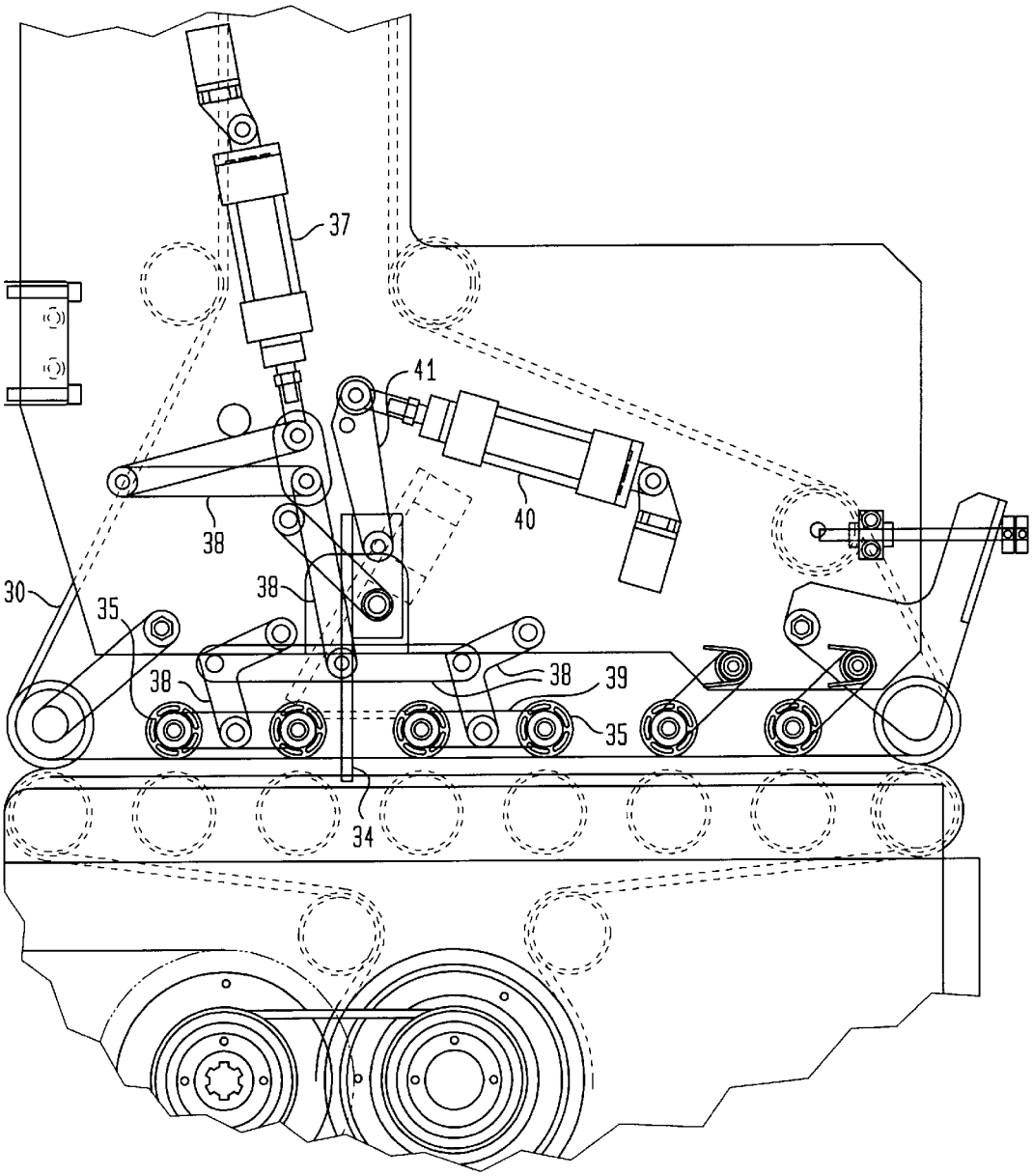
FIG. 6 is an elevational side view of a two belt squaring section.

FIG. 6 shows a side view of the two-belt squaring device. The pressure and elevation of the upper compression belts 30 is controlled by the pneumatic cylinder 37 through a set of linkages 38 supporting a carriage 39, carrying four support rollers 35. The squaring fingers 34 are controlled by pneumatic cylinder 40 through linkages 41.

Figure 7:
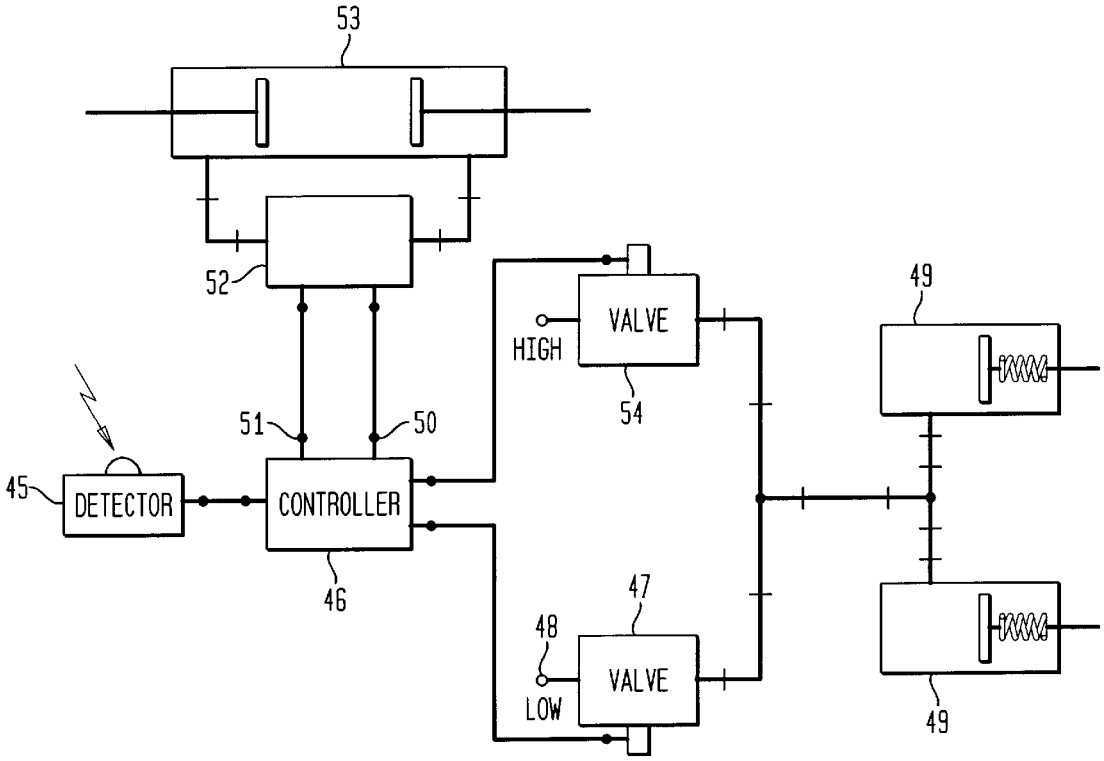
FIG. 7 is a schematic diagram of an exemplary control arrangement.

An exemplary control system for, for example, adjusting the upper compression belt pressure from a relatively lower pressure to a relatively higher pressure during the squaring cycle is illustrated in FIG. 7. The photodetector detects the leading edge of the box as it approaches the squaring fingers. It sends an electrical signed to a programmable logic controller 46 that has also received information as to the conveyor speed. It processes that information and sends an actuating voltage to a solonoid valve 47 supplied with a lower pnuematic pressure 48, for example, ranging up to 20 PSI, to the pneumatic cylinders 49 linked to the carriage 39 carrying the upper support rollers 35. These can be single acting, spring return valves. It also sends an actuating voltage through terminals 50, 51 to a valve system 52 that drives a double acting pneumatic cylinder 53 that drives the squaring fingers into and out of the intercepting position at times selected by the controller 46. At a later time, selected by the controller 46 as the completion of the squaring operation, the controller 46 signals the valving system 52 to retract the squaring fingers and sends a signal to the high pressure valve 54, supplied with pressure, for example, ranging up to 80 PSI, to increase the pressure applied by the pneumatic cylinders 49 to the upper compression belts.

What is claimed is:

1. A squaring device for use in a box folding machine for folding a box carried by a lower conveyor and gluing the box at a scam, comprising:

(a) an upper carriage upon which are mounted at least two outer belts and a pneumatically actuated central belt;

(b) means for laterally adjusting the carriage relative to the lower conveyor so that the central belt is aligned with the box's glued seam;

(c) at least two pneumatically actuated squaring fingers mounted in the upper carriage for intercepting the box's bottom panel until the box's upper panel is driven forward by the at least two outer belts until the upper panel reaches the squaring fingers, whereby the box is brought into square, and for retracting after the box is brought into square; and (d) means for varying the central belt's position during the machine's operating cycle in order to compress the glued seam after the box has been brought into square.

2. The squaring device of claim 1 comprising a photodetector situated upstream of the squaring fingers to detect the box's leading edge as it approaches the squaring fingers and to produce an electrical signal when the leading edge is detected.

3. The squaring device of claim 2 comprising a controller for accepting the electrical signal, processing the electrical signal together with the lower conveyor's speed and producing a first output signal at a first selected time, whereby the squaring fingers are actuated to an intercepting position.

4. A squaring device of claim 3 in which the electrical signal is processed to produce a second output signal at a second selected time whereby the squaring fingers are retracted out of the intercepting position and the central belt is lowered to compress the glued seam.

5. A squaring device for use in a box folding machine for folding a box carried by a lower conveyor and gluing the box at a seam, comprising:

(a) an upper carriage upon which are independently mounted two pneumatically actuated upper belts, each linked to a separate pneumatic cylinder, each pneumatic cylinder being provided with a pressure input port;

(b) means for laterally adjusting the carriage relative to the lower conveyor so that the two belts are positioned on either side of the scam;

(c) at least two pneumatically actuated squaring fingers mounted in the upper carriage for intercepting the box's bottom panel and arresting its forward progress until the box's upper panel is driven forward by the upper belts to meet the squaring fingers, whereby the box is brought into square; and (d) first pressure means for applying a first pneumatic pressure to the pressure input port while the squaring fingers are in the intercepting position and second pressure means for applying a second pneumatic pressure to the pressure input port after the squaring fingers are retracted from the intercepting position, wherein the second pneumatic pressure is higher than the first pneumatic pressure.

6. The squaring device of claim 5 comprising a photodetector situated upstream of the squaring fingers to detect the box's leading edge as the leading edge approaches the squaring fingers and to produce an electrical signal when the leading edge is detected.

7. The squaring device of claim 6 comprising a controller for accepting the electrical signal, processing the electrical signal together with the lower conveyor's speed and producing a first output signal at a first selected time, whereby the squaring fingers are actuated to an intercepting position.

8. The squaring device of claim 7 in which the electrical signal is processed to produce a second output signal at a second selected time whereby the squaring fingers are retracted out of the intercepting position and the second pneumatic pressure is supplied to the pressure input port.

9. A squaring device for use in a box folding machine for folding a box carried by a lower conveyor and gluing the box at a seam, comprising:

(a) an upper carriage upon which are mounted a plurality of upper drive belts coupled to pneumatically actuated compression means for varying the pressure exerted by at least one of the upper drive belts on the box during selected portions of the squaring device operating cycle;

(b) means for laterally adjusting the carriage relative to the lower conveyor so that the upper drive belts are positioned on either side of the seam;

(c) means for laterally adjusting the upper carriage relative to the lower conveyor to position the squaring fingers at the seam; and (d) pressure control means for applying selectively variable pneumatic pressure to the compression means.

10. The squaring device of claim 9 in which the compression means applies a relatively lower pressure to at least one of the upper belts while the squaring fingers are intercepting and relatively higher pressure to at least one of the upper belts when the squaring fingers are retracted.

* * * * *